US006363994B1

(12) United States Patent
Roberts et al.

(10) Patent No.: US 6,363,994 B1
(45) Date of Patent: Apr. 2, 2002

(54) DECORATIVE WALL MOUNTING AND MOUNT THEREFOR

(76) Inventors: Beverly Roberts, 395 Castleridge Dr. NE., Atlanta, GA (US) 30342; David Reid Roberts, 13959 N. Eddington Pl., Oro Valley, AZ (US) 85737

( * ) Notice: Subject to any disclaimer, the term of this patent is extended or adjusted under 35 U.S.C. 154(b) by 0 days.

(21) Appl. No.: 09/710,994

(22) Filed: Nov. 9, 2000

(51) Int. Cl.[7] ..... A47H 23/01

(52) U.S. Cl. ..... 160/349.1; 248/217.3; 248/262

(58) Field of Search ..... 160/349.1, 349.2, 160/38, 39, 348, 19, 330, 127, 128; 248/217.3, 216.4, 262, 264, 316.8

(56) References Cited

U.S. PATENT DOCUMENTS 673,412 A * 5/1901 Baker ..... 160/330
789,390 A * 5/1905 Smith ..... 160/330
929,923 A * 8/1909 Drinkaus ..... 160/330
1,030,205 A * 6/1912 Peplowski ..... 248/262
2,570,731 A * 10/1951 Susnow ..... 160/38
3,090,088 A * 5/1963 Foley et al. ..... 248/217.3
4,903,394 A 2/1990 Roberts ..... 29/458
5,042,549 A 8/1991 Roberts ..... 160/39
5,785,104 A * 7/1998 Riley et al. ..... 160/38
6,085,821 A 7/2000 Roberts ..... 160/38

* cited by examiner

*Primary Examiner*—David M. Purol
(74) *Attorney, Agent, or Firm*—Thomas, Kayden, Horstemeyer & Risley LLP.

(57) ABSTRACT

A decorative device, known as a corbel, for mounting to walls adjacent windows, for example, to create a window treatment, has a mounting bracket therefor. The device is made of a material such as expanded polystyrene, and the mounting bracket has sharpened tangs which penetrate the body of the device and grip it. The device further has a slot in the top thereof into which a depending leg of the bracket fits. With the leg in the slot and the tangs penetrating into the body, the device is affixed to, and firmly held by, the bracket. The device itself may be covered with decorative material and support other decorative devices such as scarves, curtain rods, and drapes, for example.

7 Claims, 8 Drawing Sheets

DECORATIVE WALL MOUNTING AND MOUNT THEREFOR

FIELD OF THE INVENTION

This invention deals with a decorative wall mount for window and other treatments and, more particularly, to a corbel and a mounting bracket therefor.

RELATED PATENTS

U.S. Pat. Nos. 4,903,394, 5,042,549, and 6,085,821 all of Beverly R. Roberts, deal with the decorative treatment of windows.

BACKGROUND OF THE INVENTION

While the present invention, as will be readily apparent hereinafter, has a wide range of uses, for purpose of the present description the invention will be treated as primarily a window top treatment.

There are, in use today, numerous types of window top treatments, characterized as either "hard" or "soft". Examples of the "hard" or structured treatments are the cornice board, lambrequin, and the cantoniere. Each of these treatments uses a unit which is made of rigid material and which has front, top, and side members of varying lengths, to which decorative fabric or material is attached which follows the shape and form of the unit. The "soft" treatment is exemplified by the valance, which is the most often used due to its simplicity, variety, economy, and versatility.

In general, a valance is a decorative fabric arrangement used as a top treatment over windows. It can be made in a variety of fabrics and styles, with the fabric itself hanging from a horizontal support unit positioned above the window. Other than the attachment of the fabric to the support unit, there is no additional fabric supporting hardware and thus the fabric has an unrestricted freedom to give a soft, draping, unstructured appearance. The support unit may take any of a number of forms, as shown and described in the aforementioned Roberts patents. As discussed in those patents, for example, the support unit may be in the form of rods, rings, hoops, swag holders, and the like, all of which have limited versatility that does not allow creation of the "Georgian" style or contemporary or casual styles. The Roberts patents disclose window treatment devices that do have such versatility and, further, that solve prior existing problems of the materials used to make window treatment devices.

Each of the patents is directed to a "consumer friendly" device, a principal part of which is made of expanded polystyrene which is light weight, easily workable, inert, non-insect attracting, and odor free. It is contemplated that when such devices are supplied to consumers in kit form, the consumer can readily assemble, attach decorative material thereto, and mount the device without the need of special tools or the like.

Although the arrangement shown in these patents represent a great increase in versatility, even greater versatility, convenience, and ease of use are desiderata to which the present invention is directed.

SUMMARY OF THE INVENTION

The present invention is a device generically known as a corbel, and a mounting bracket therefor. A corbel is an architectural device generally used to support a cornice or an arch, and generally is used on building exteriors.

The present invention is an adaptation of the corbel for use indoors to serve as a decorative treatment device usable in window treatments, bed canopies, wall sconces or brackets, support for curtain or drapery rods, and even picture easels.

In greater detail, the corbel of the invention comprises a body member made of an expanded polystyrene or other lightweight porous material to which can be affixed decorative material, such as fabrics or the like by means of pins, staples, tacks, adhesive, or any of a number of suitable affixing means. In practice, the fastening means should be unobtrusive, the realization of which is easiest by the use of adhesives or a combination of pins and adhesive, but it is not intended that this disclosure be restricted thereto.

In a first embodiment of the invention, the corbel has the classic corbel shape of a rear flat surface, a flat top surface, a roughly S-shaped front surface, and a flat bottom surface. A stress bearing surface is created by a narrow slit cut into the top surface and extends either partially or entirely thereacross, substantially parallel to the plane of the rear surface. The S-shape creates an upper or central portion of the corbel that is substantially deeper from front to rear than is the lower portion. Within the upper or central portion is a bore which extends completely through the portion approximately parallel to the plane of the rear surface. As will be apparent from the following detailed description and figures, this transverse bore can serve to hold curtains or drapes or other fabrics, or may be used to hold a rod extending between twin corbels on either side of the upper portion of a window, or other object, such as a mirror, that it is desirable to decorate. The references to "upper," "lower," "front," "rear,", and "top" and "bottom" are to the orientation of the device as shown in the figures and not necessarily to the orientation of use.

Because of the thickness or depth from front to back of at least the upper portion of the corbel, which makes mounting the corbel in other than a permanent mount difficult, the present invention includes a mounting bracket therefor.

The mounting bracket comprises an elongated flat rear member having front and rear surfaces of suitable material such as sheet metal or thin, hard plastic having first and second spaced mounting holes therein for mounting the bracket to the wall with suitable means, such as moly bolts, toggle bolts, or wall board screws or bolts. The upper end of the elongated rear member has a square U-shape with a forward extending spacer member and a short depending leg. The spacing between the rear member and the depending leg is roughly equal to the spacing between the rear surface of the corbel and the transverse stress bearing surface created by the slit in the top thereof, into which the depending leg fits. Extending from the front surface of the rear member of the bracket are one or more retaining members such as spaced tangs having pointed ends. It is to be understood that there may be more than two mounting holes and, preferably two or more spaced tangs. It is also to be understood that tangs are used herein as preferred retaining members, but that members other than tangs might readily be used.

In mounting the corbel to a wall, the bracket is first mounted thereto by suitable means, as discussed. The top of the corbel is then inserted into the space between the rear member and the front leg of the b racket by cocking the corbel so that the leg of the depending bracket is aligned with the slit in the corbel. The lower portion of the corbel is then rotated toward the bracket, driving, the tangs into the rear surface of the corbel until the rear surface is flush with the rear member of the bracket, and the depending lea of the bracket is fully inserted in the slit, thereby firmly securing the corbel to the bracket.

In use, as will be clear hereinafter, the weight of decorative material and the weight of the rod, if one is used, exercise both a vertical, downward force on the bracket and a rotational force. The tangs or other retaining members resist the downward force and the depending leg of the bracket resists the rotational force. As a consequence, the corbel is firmly held in place even though the weight of the decorative material is considerable. In addition, when the corbel is mounted to the bracket, the spacer member of the U-shaped portion of the bracket is not readily visible, being located, generally, above normal view height.

As will be apparent from the detailed description hereinafter, the basic structure described hereinbefore is adaptable to a wide variety of decorative arrangements, such as, for example, a window treatment with a fabric scarf, a window treatment with a rod and curtain or drapes, a mock bed canopy, or wall brackets or sconces. In addition, modification to the shape of the corbel can add further capabilities such as, in one embodiment of the invention, a depression formed in the front of the corbel can convert the corbel to use as a picture or mirror easel or holder. In another embodiment, the stress bearing surface may be part of the front surface.

The numerous features and advantages of the present invention will be more readily apparent from the following detailed description, read in conjunction with the accompanying drawings.

DETAILED DESCRIPTION

Figure 1:
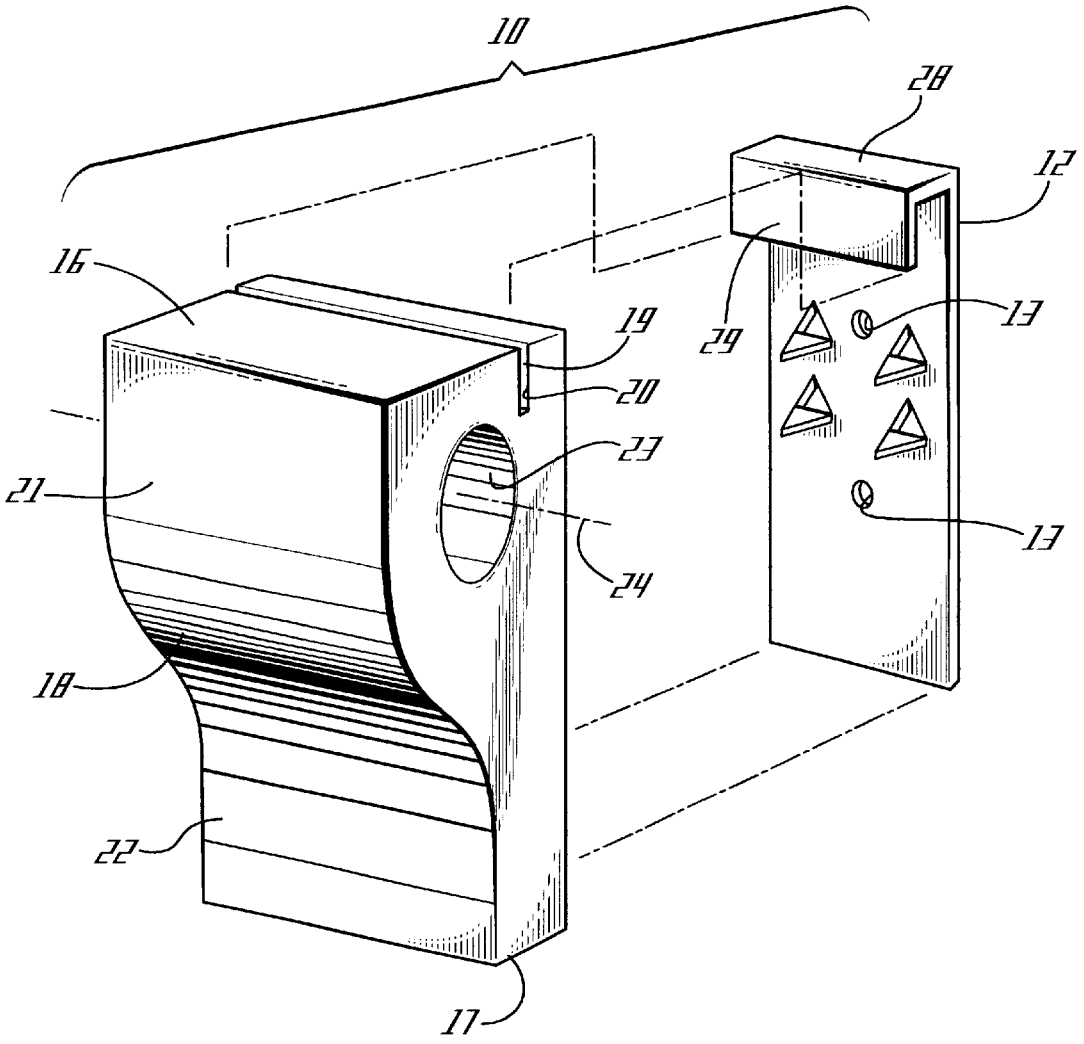
FIG. 1 is an exploded view, in perspective, of the corbel and mounting bracket of the invention.

FIG. 1 is an exploded perspective view of the corbel assembly of the invention. Assembly 10 comprises a corbel body 11 and a mounting bracket 12 therefor. As pictured, and as will be the convention for the following discussion, bracket 12, which may be made of suitable thin sheet metal, such as, for example, aluminum, or thin rigid plastic, is adapted to be mounted to a wall by means of mounting holes 13 and is shown in its vertical mounted position. Plaster board screws, toggle bolts, moly bolts, or screw-anchor means may be used to mount bracket 12 to the wall. Other means not here enumerated might also be used.

Figure 2A:
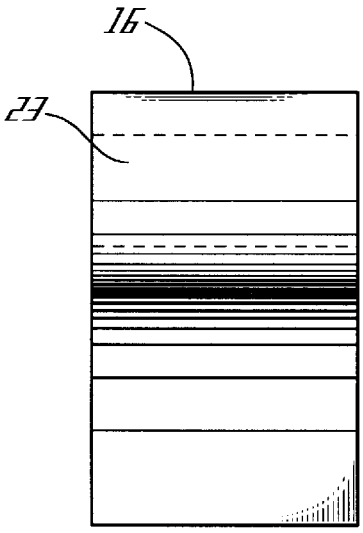
FIG. 2(*a*) is a front elevation view of one embodiment of the corbel of the invention and FIG. 2(*b*) is a side elevation view thereof.
Figure 2B:
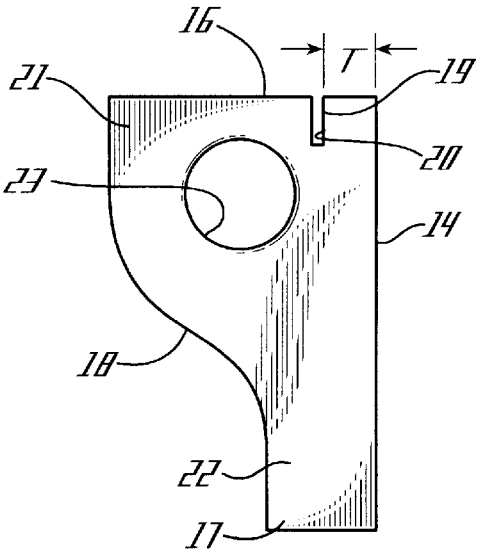

Corbel body 11 comprises a block of, for example, expanded polystyrene or other suitable material having the characteristics of rigidity, light weight, and which is readily receptive to the insertion of pins, tangs, or other sharp members therein. With reference to FIGS. 2(*a*) and 2(*b*) as well as FIG. 1, body 11 has a flat rear surface 14, a flat top surface 16, a flat bottom surface 17, and a substantially S-shaped front surface 18. As will be apparent hereinafter, the shape of body 11 may have any of a number of variations commensurate with the decorative configuration desired. The shape shown in FIGS. 1, 2(*a*) and 2(*b*) is substantially a standard corbel shape. Top surface 16 has a slot 19 therein which extends into the body 11 substantially parallel to the plane of rear surface 14 thereby creating a stress bearing surface 20 within the slot 19. The stress bearing surface 20 in this embodiment is the rear wall of the slot 19. As shown in FIG. 1, slot 19 extends across the width of body 11, although it is not strictly necessary that this be the case. It is simply easier to make a straight cut entirely across the body 11. It can be seen that the S-shape of surface 18 results in a relatively thick (front to back) upper portion 21 of body 11, and a relatively thin lower portion 22. Upper portion 21 has a bore 23 extending thereacross the centerline 24 of which is substantially parallel to the plane of rear surface 14.

Figure 3A:
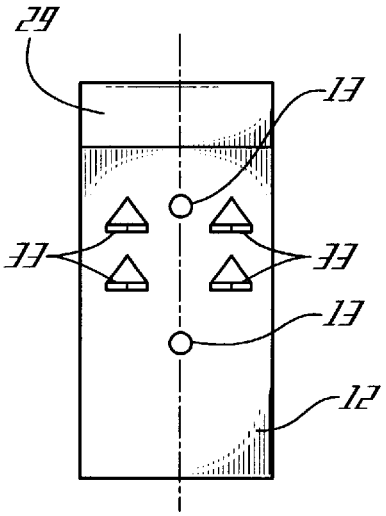
FIG. 3(*a*) is front elevation view of the mounting bracket of the invention and FIG. 3(*b*) is a side elevation view thereof.
Figure 3B:
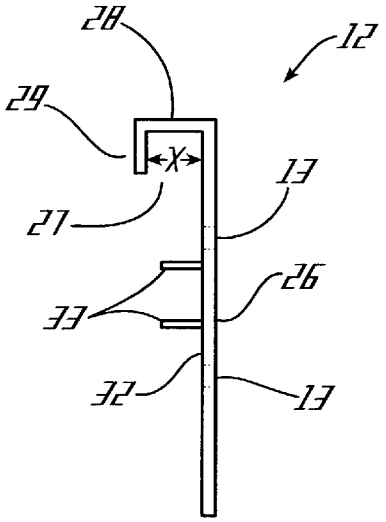
Figure 4A:
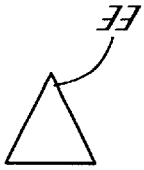
FIGS. 4(*a*), 4(*b*), AND 4(*c*) are plan views of several alternative forms for an element of the bracket of FIGS. 2(*a*) and 2(*b*)
Figure 4B:
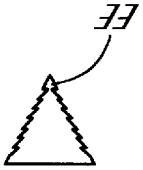
Figure 4C:
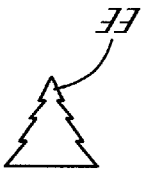

With reference to FIGS. 1 and 3(*a*) and 3(*b*), bracket 12 comprises an elongated flat plate 26 having formed, at the upper end thereof, a U-shaped channel 27 formed by a forward extending spacing member 28 and a depending leg 29. The width X of channel 27 is substantially the same as the distance Y of surface 20 in slot 19 from rear surface 14 on corbel body 11. Plate 26 has first and second spaced mounting holes 13 therein for mounting bracket 12 to a wall, for example, by suitable means such as moly bolts or the like, examples of which have been mentioned hereinbefore. Although only two spaced holes 13 have been shown, any suitable number oriented as desired or necessary may be used for anchoring brackets 12 in place. Extending from the front surface 32 of plate 26 is a plurality of pointed tangs 33 which may be formed by making triangle cuts in plate 26 and bending the cut portions (tangs 33) forward. As will be apparent hereinafter tangs 33 are sufficiently sharp that when the corbel surface 14 is pressed thereagainst, they penetrate the body of the corbel 11 to anchor it in place against bracket 12. Tangs 33 may have other than a triangular shape, and they may project from surface 32 at a slight angle, or at several different angles. The triangular shape of FIG. 4(*a*) itself may be modified, as shown in FIG. 4(*b*), with serrated edges, or FIG. 4(*c*), with barbs. These modifications, and others of similar nature, are intended to enhance the gripping action of the tangs 33 within corbel 11. While only four tangs 33 have been shown, it is to be understood that several more, or fewer tangs may be used, and their orientation need not be symmetrical, as shown in FIG. 3(*a*).

Figure 5A:
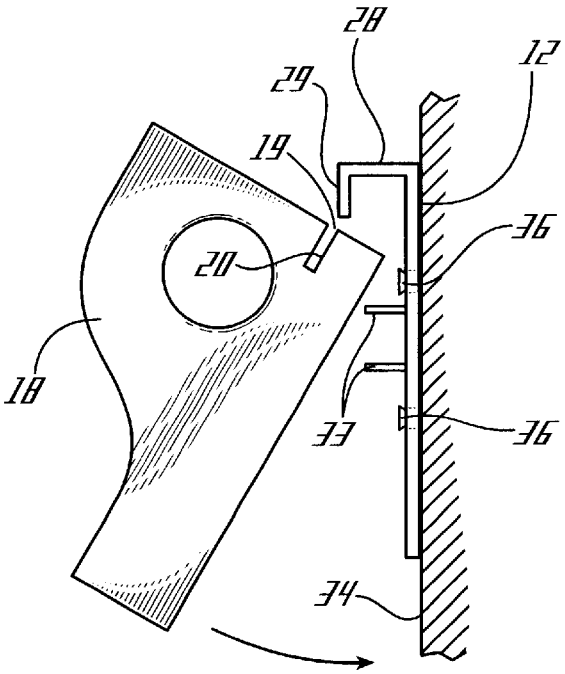
FIGS. 5(*a*) and 5(*b*) illustrate the method of mounting the corbel of the invention to the mounting bracket of the invention.
Figure 5B:
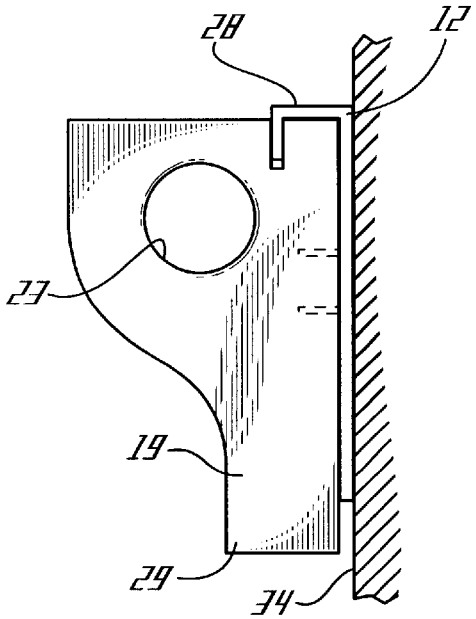

FIGS. 5(*a*) and 5(*b*) illustrate the manner in which corbel 11 is mounted to, and secured by, bracket 12. With bracket 12 mounted to a wall 34 by suitable flat head bolts or recessed bolts or screws 36, for example, corbel 11 is placed at an angle to bracket 12 and slot 19 is aligned with leg 29 and then rotated in the direction of the arrow to cause leg 29 to enter slot 19 and tangs 33 to enter the rear of corbel 11 as shown in FIG. 5(*b*) to affix corbel 11 to bracket 12. Corbel 11 is held firmly in place on bracket 12 despite the loads and stresses to which the corbel 11 may be subjected.

Figure 6:
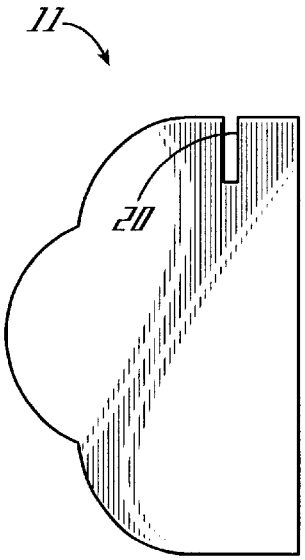
FIG. 6 illustrates an alternative shape of the corbel of the invention.
Figure 7:
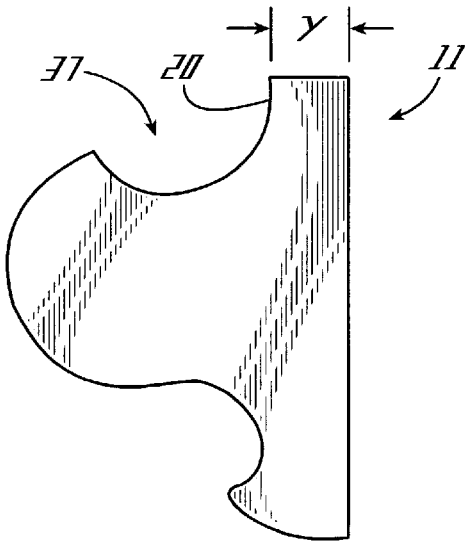
FIG. 7 illustrates another alternative form or shape of the corbel of the invention.
Figure 12:
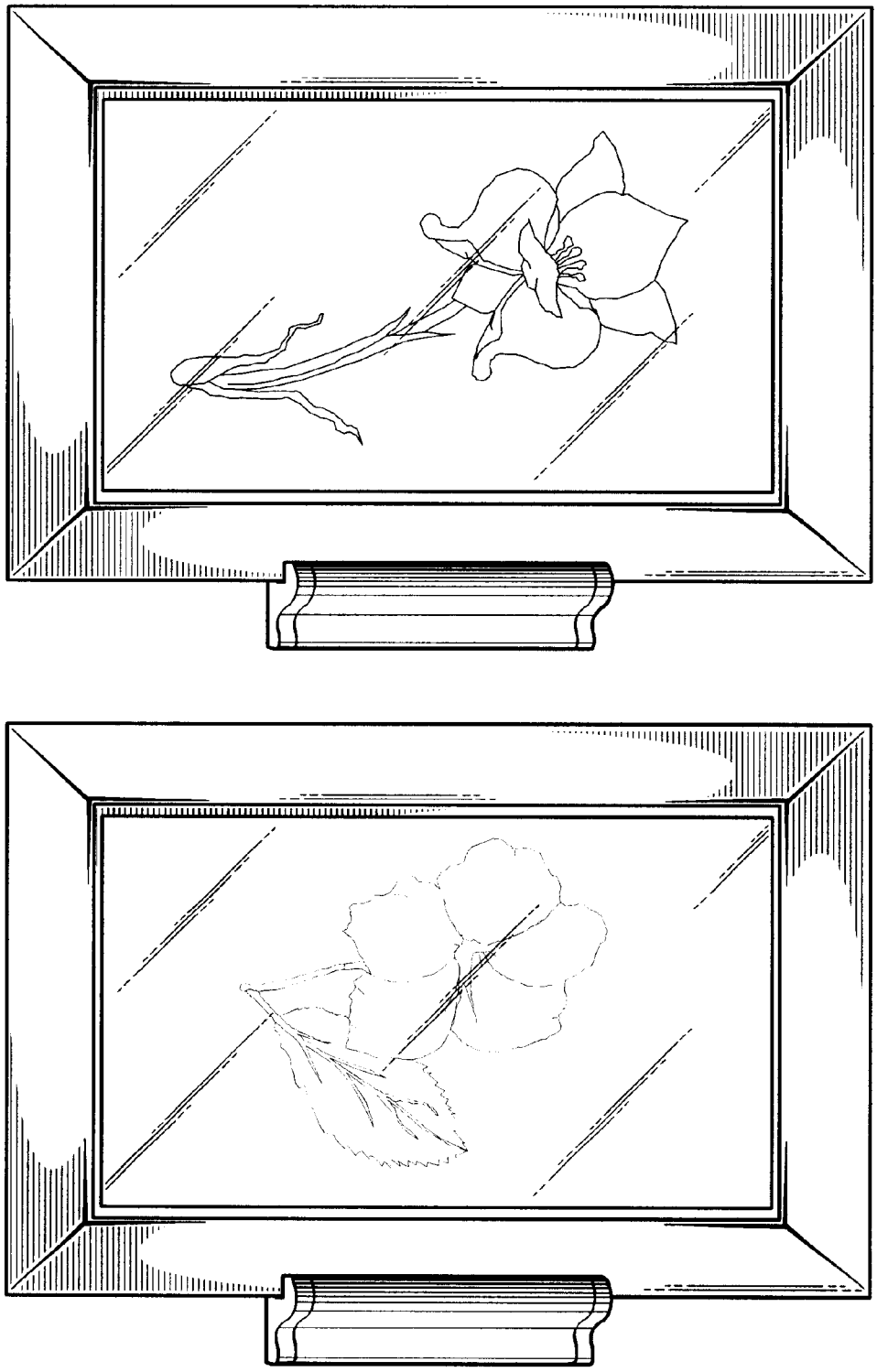
FIG. 12 illustrates the corbel of FIG. 7 used as a wall mount or easel for a picture.

As was pointed out hereinbefore, corbel 11 may have any of a number of shapes, depending on its intended use. FIGS. 6 and 7 are examples of two shapes that are useful, especially that shown in FIG. 7, wherein the corbel 11 has a groove 37 therein and is intended to function as a decorative support for a picture frame or the like which rests in groove 37 as shown in FIG. 12. In this embodiment, the stress bearing surface 20 is formed by a straight section on the rear upper portion of groove 37. The corbel 11 can be decorated in any of a number of ways by fabric, paper, paint or other decorative medium.

The versatility of the corbel and mount of the present invention is illustrated in FIGS. 8 through 12. In several of these figures, the corbel shape may be different from the shapes already illustrated and/or discussed. This illustrates the adaptability of the invention to any of a number of decorative schemes.

Figure 8:
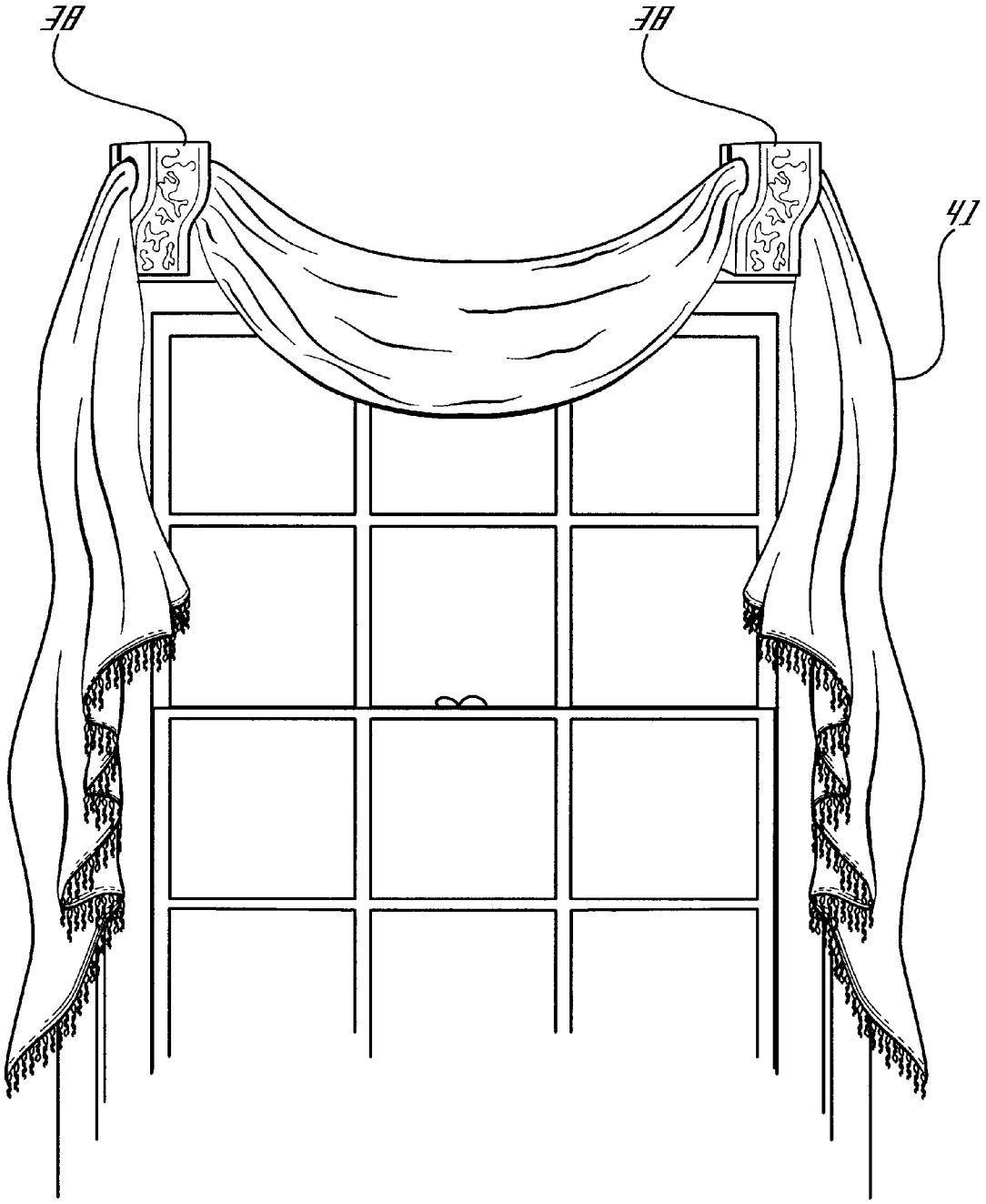
FIG. 8 depicts two corbels of the invention used, in conjunction with a scarf, as a window treatment.

In FIG. 8, two decorated corbels 38 and 39 are mounted above a window on either side, and a decorative scarf 41 is hung therefrom, being supported, as shown, by the bores 23 in the corbels.

Figure 9:
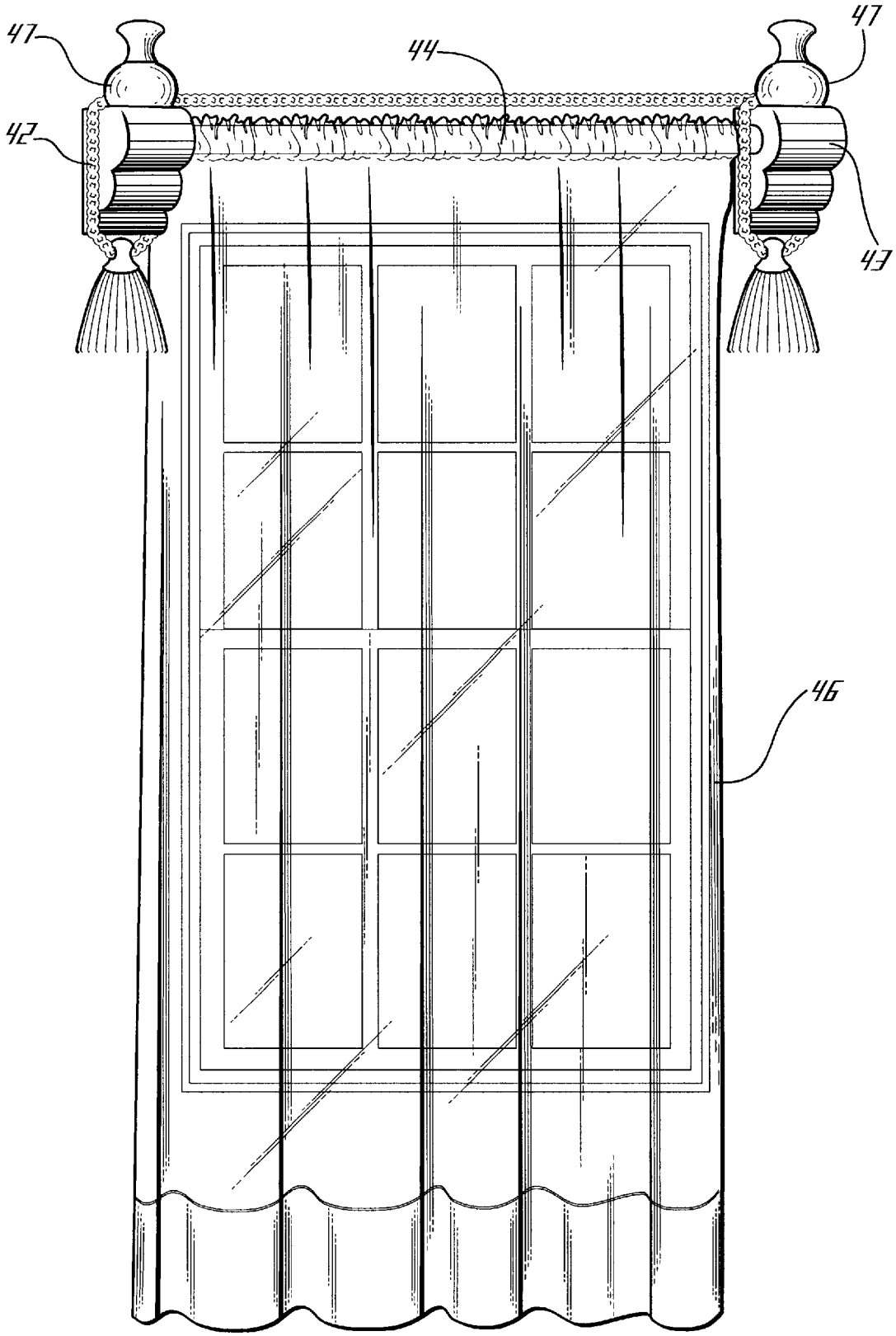
FIG. 9 depicts two corbels of the invention used, in conjunction with a rod, as a curtain or drape treatment for a window.

In FIG. 9 decorated corbels 42 and 43 are located on either side of a window at the top thereof, and a rod 44 extends therebetween, supported in the bores 23. A curtain or drape 46 is supported by the rod 44, as shown. As further shown in FIG. 9, the flat upper surface 16 of each corbel may hold a decorative device 47, such as a small urn.

Figure 10:
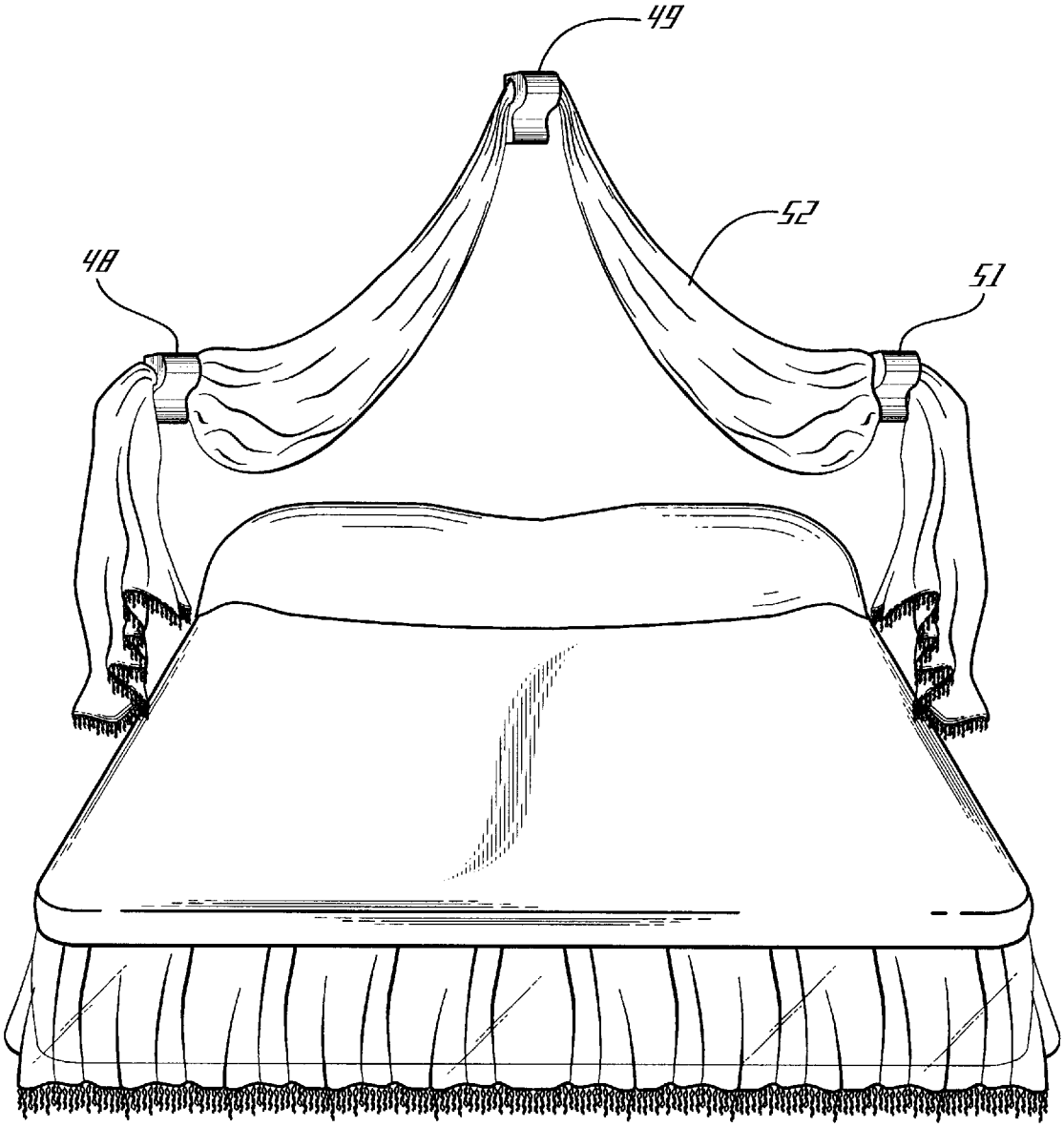
FIG. 10 depicts three corbels of the invention used, with suitable scarf or drape, to form a mock bed canopy.

The arrangement of FIG. 10 is a mock bed canopy comprising three corbels 48 49, and 51 with the canopy drape 52 passed through and held by the three bores 23.

Figure 11:
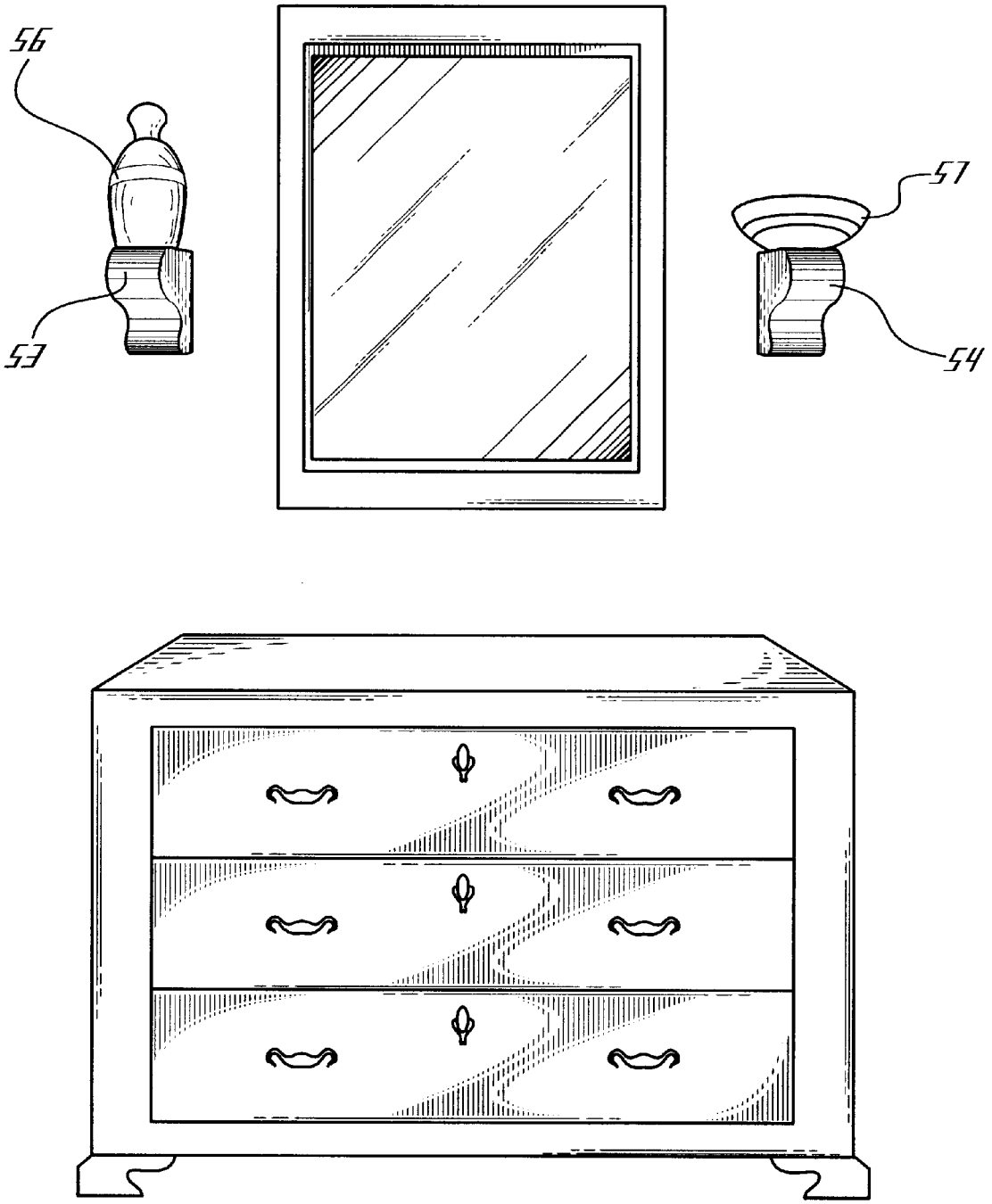
FIG. 11 depicts two corbels of the invention used as wall mounted brackets or sconces.

FIG. 11 shows two corbels 53 and 54 serving as wall sconces on either side of a mirror, for example, and supporting decorative devices 56 and 57.

FIG. 12 illustrates the corbel 11 of FIG. 7 wherein a picture frame rests in groove 37 as discussed hereinbefore.

The foregoing has been intended to illustrate the principles and features of the present invention, and to illustrate the great versatility thereof. The device of the invention is readily amenable to dissemination in kit form and requires no special tools or apparatus to produce the finished product in a pleasing and decorative illustration.

It is to be understood that the various features of the present invention might be incorporated into decorative schemes different from those illustrated and that numerous modifications or adaptations might occur to workers in the art. All such variations and modifications are intended to be included herein as being within the scope of the invention as set forth. Further, in the claims hereinafter, the corresponding structures, materials, acts, and equivalents of all means or step-plus-function elements are intended to include any structure, material, or acts for performing the functions in combination with other elements as specifically claimed.

What is claimed is:

1. A decorative device assembly for mounting to a substantially flat surface, said assembly comprising:

a first body member having a front surface, a rear, substantially flat body surface and a top portion having a stress bearing surface spaced from said rear flat body surface, said stress bearing surface being formed by a slot in said top portion; and a mounting bracket comprising an elongated plate member having front and substantially flat surfaces and a U-shaped portion, said U-shaped portion having a leg spaced from said front surface a distance substantially equal to the spacing of said stress bearing surface from said flat body surface, said leg being adapted to bear against said stress bearing surface when said flat body surface bears against said front surface.

2. A decorative device assembly for mounting to a substantially flat surface, said assembly comprising:

a first body member having a front surface configured to form a relatively thick portion, a rear, substantially flat body surface, a top portion having a stress bearing surface spaced from said rear flat body surface, and first and second sides, said relatively thick portion having a transverse bore extending therethrough from the first side to the second side; and a mounting bracket comprising an elongated plate member having front and rear substantially flat surfaces and a U-shaped portion, said U-shaped portion having a leg spaced from said front surface a distance substantially equal to the spacing of said stress bearing surface from said flat body surface, said leg being adapted to bear against said stress bearing surface when said flat body surface bears against said front surface.

3. A decorative device assembly as claimed in claim 2 wherein said bore is substantially parallel to the plane of said rear body surface.

4. A decorative device assembly as claimed in claim 2 and further including a second body member and bracket therefor spaced from said first body member and bracket therefor, said second body member having a transverse bore extending therethrough; and an elongated support member extending between said first and second body members and supported in said bores therein.

5. A decorative device assembly for mounting to a substantially flat surface, said assembly comprising:

a first body member having a front surface, a rear, substantially flat body surface, a top portion having a stress bearing surface spaced from said rear flat body surface and first and second sides, said front surface having a transverse groove extending between said first and second sides substantially parallel to the plane of said rear body surface; and a mounting bracket comprising an elongated plate member having front and rear substantially flat surfaces and a U-shaped portion, said U-shaped portion having a leg spaced from said front surface a distance substantially equal to the spacing of said stress bearing surface from said flat body surface, said leg being adapted to bear against said stress bearing surface when said flat body surface bears against said front surface.

6. A decorative display assembly as claimed in claim 1 wherein said front flat surface of said mounting bracket has at least one retaining member extending therefrom and engaging said rear body surface of said body member remote from said U-shaped portion.

7. A decorative display assembly as claimed in claim 1 wherein said first body member is made of a lightweight porous material.

* * * * *